United States Patent [19]

Alberny et al.

[11] 4,059,142

[45] Nov. 22, 1977

[54] CONTINUOUS CASTING OF A METALLIC PRODUCT BY ELECTROMAGNETIC CENTRIFUGING

[75] Inventors: Robert Alberny; Jean Pierre Birat, both of Metz; Roger Ventavoli, Algrange, all of France

[73] Assignee: Institut de Recherches de la Siderurgie Francaise (IRSID), St. Germain-en-Laye, France

[21] Appl. No.: 760,428

[22] Filed: Jan. 18, 1977

[30] Foreign Application Priority Data

Jan. 20, 1976 France ..... 76.01347

[51] Int. Cl.[2] ..... B22D 11/10; B22D 27/02

[52] U.S. Cl. ..... 164/49; 164/82; 164/147; 164/250; 164/443

[58] Field of Search ..... 164/49, 82, 147, 250, 164/283 M

[56] References Cited

U.S. PATENT DOCUMENTS

| | | | |
|---|---|---|---|
| 2,877,525 | 3/1959 | Schaaber | 164/82 X |
| 2,963,758 | 12/1960 | Pestel et al. | 164/49 X |
| 3,981,345 | 9/1976 | Alberny et al. | 164/49 |
| 4,016,926 | 4/1977 | Yamada et al. | 164/147 |

*Primary Examiner*—Robert L. Spicer, Jr.
*Attorney, Agent, or Firm*—Kurt Kelman

[57] ABSTRACT

A metallic product is cast continuously by injecting a liquid metal into a cooled ingot mold, applying a magnetic field turning about the axis of the mold to rotate the metal, and extracting the partially solidified metal product from the mold. Effective stirring is obtained by rotating the magnetic field at a frequency of rotation of 4 to 15 Hertz and using a copper alloy of structural rigidity for the mold, the wall thickness of the mold being kept thin, preferably below 15 mm. The process is particularly useful for casting round metallic products and especially those which are subjected to after-treatments requiring good surface characteristics and a core free of faults.

7 Claims, No Drawings

CONTINUOUS CASTING OF A METALLIC PRODUCT BY ELECTROMAGNETIC CENTRIFUGING

The present invention relates to improvements in the continuous casting of a metallic product, wherein a liquid metal is stirred in an ingot mold by applying thereto a turning magnetic field.

Stirring liquid metal during continuous casting in an ingot mold by applying to the metal a magnetic field turning about the axis of the mold is well known and a mold useful for this purpose is disclosed, for instance, in U.S. patent application Ser. No. 699,353, filed June 24, 1976, now U.S. Pat. No. 4,026,346, whose disclosure is incorporated herein by way of reference. While the principle is simple, it is by no means simple to operate this process and, as a matter of fact, the technological dfficulties have proved to be so great that the process has not yet been developed on an industrial scale. Therefore, commercial continuous casting installations generally comprise machines without stirring or machines with mechanical centrifuging, which constitute a considerable technical advance and wherein the liquid metal is stirred by rotating the mold about its axis and tangentially injecting the liquid metal into the mold.

Actually, stirring of the liquid metal plays an essential role in obtaining ingots of good quality because it influences not only the surface characteristics but also the core structure of the ingot. The scum is entrained by the movement of the metal and is collected on its surface whence it may readily be removed. On the other hand, billets produced from well stirred liquid metal have a short basaltique zone followed by a large equi-axial zone, and the core is free of solification heterogeneities. For this reason, it is of considerable interest to develop a process of continuously casting a metallic product by electromagnetic centrifuging, which can be operated on an industrial scale. We have now succeeded in finding the proper operating conditions for obtaining maximal stirring intensity of the liquid metal in a mold wherein the metal is continuously cast and stirred by an electromagnetic inductor of a shape acceptable for insertion in a continuous casing installation.

It is the primary object of this invention to obtain such maximal stirring of the liquid metal in the continuous casting mold while assuring good caloric extraction and satisfactory mechanical strength of the mold.

This and other objects are accomplished by the invention in continuously casting a metallic product by electromagnetic centrifuging, wherein a liquid metal is injected into a cooled ingot mold having an axis, the metal is rotated by applying thereto a magnetic field turning about the axis of the mold, the magnetic field being produced by a polyphase inductor placed in the immediate proximity of the cast product, and the metal is extracted from the mold in partially solidified condition, by the step of obtaining a maximal stirring intensity of the liquid metal in the mold by (a) rotating the magnetic field at a frequency of rotation of 4 to 15 Hertz, (b) using a copper alloy of structural rigidity for the mold, and (c) keeping the thickness of the mold wall below a value calculated by the formula $$\frac{\log\left(\frac{d-2e}{d}\right)}{1-\left(\frac{d-2e}{d}\right)^2} = \frac{0.6 \times Re \times \lambda(1-\mu)}{E\,\alpha\,\phi} - \frac{1}{2}$$

wherein $e$ = the thickness of the wall;
$d$ = the diameter of the mold;
$\alpha$ = linear expansion coefficient,
$\lambda$ = thermal conductivity in cal/cm.sec.° C,
$E$ = Young modlus in kg/mm$^2$,
$\mu$ = Poisson coefficient and
$Re$ = elastic limit in kg/mm$^2$ of the wall material; and
$\Phi$ = thermal flux at the level of the meniscus in cal/cm$^2$/sec.

This maximal stirring of the liquid metal in the mold according to the present invention is independent of the intensity of the magnetic field produced by the inductor, i.e. the technological characteristics thereof, such as the number of coils per unit of length or the intensity of the exciting current. Nevertheless, it will be understood that there is a lower limit of the effective intensity of the magnetic field below which the process will lose commercial value. In this respect, it is generally assumed that the inductor must produce a turning magnetic field having a minimum effective intensity of 800 G, preferably between 1000 and 2000 G. Such intensities may readily be obtained with conventional inductors.

Similarly, because the magnetic field weakens with distance, it will be preferred particularly with inductors producing a field of the order of 800 to 1000 Gauss, to place the inductor in the immediate proximity of the cast product, i.e. directly behind the mold. It may also be noted that, above a certain field intensity estimated at about 2000 Gauss, there is a risk of stirring the liquid metal under the given operating conditions so strongly that the metal may be ejected from the mold.

The thickness of the mold wall will under any circumstances be less than 15 mm, a preferred thickness being about 8 mm. The preferred frequency of rotation of the magnetic field is between 6 and 12 Hertz.

While applicants do not wish to be bound by any theories, the problems heretofore encountered now appear to be fairly clear. The purpose of applying a magnetic field is to rotate the liquid metal in the mold and the essential difficulty resides in producing a sufficient stirring intensity. This intensity is, on the one hand, linearly proportional to the angular speed of rotation of the magnetic field and, on the other hand, proportional to the square of the average value of the field applied to the metal bath. However, this average value is not independent of the angular speed. In fact, it varies inversely with the latter because of the electric properties of the materials traversed by the field from the wall of the inductor to the liquid metal. The field is strongly attenuated by the creation of Foucault current as it traverses the mold wall generally made of copper which has a high electric conductivity and must be of appreciable thickness to assure satisfactory mechanical strength.

In view of these considerations, proper stirring could in principle be obtained with a magnetic field turning at a frequency of the electric network (50 Hz). But to obtain sufficient intensity of such a field in steel, it would have been necessary to use an inductor producing a very intense field in the absence of liquid metal requiring a highly sophisticated technology and large dimensions, i.e. not readily compatible with the shape of industrially used continuous casting installations.

Furthermore, even at a much lower frequency of rotation, for example 20 Hz, the present state of the art does not provide an inductor of acceptable dimensions producing a magnetic field sufficient to stir a metallic bath effectively. For very small angular velocities, conventional inductors, i.e. such as will produce a magnetic field in the absence of liquid metal of the order of 1500 G, would appear to work. However, as has been indicated hereinabove, the angular velocity of the field is linearly proportional to the stirring intensity and this remains insufficient to obtain the required metallurgical results.

As has been emphasized, it is extremely important to assure effective stirring of the liquid metal and to select the applied magnetic field and the mold structure with this end in view. But it must not be forgotten that it is, above all, essential to provide for a very efficient heat extraction at the level of the mold so as to assure a metal skin of sufficient and regular thickness to be able to remove the partially solidified metal product rapidly from the mold. At the same time, considering the severe temperature conditions and the mechanical constraints prevalent at the level of the mold, it is indispensible to make certain that the mold has good mechanical strength. Thus, in constructing a continuous casting apparatus capable of economical commercial operation, a number of factors must be so coordinated that they will, in combination, produce the desired result. Thus, if undue weakening of the magnetic field by the mold is to be avoided, a material of high resistance must be used for the mold walls. But since the electric conductivity and the thermal conductivity vary in the same manner, an increase in the temperature of the mold wall risks a permanent deformation thereof. Therefore, it is practically impossible to use for the mold a material with very low screening effect and, accordingly, to avoid excessive attenuation, it is necessary to apply a magnetic field turning at a low frequency of rotation.

For this reason, we have selected as material for the mold wall copper alloys whose electric conductivity is less than that of pure copper metal, without having an excessively low thermal conductivity, and which, furthermore, have good mechanical properties. These are alloys having structural rigidity, i.e. elements of such alloys are readily soluble in copper at high temperature but much less so as the temperature decreases. When such alloys are tempered, a solid super-saturated solution is obtained at ordinary temperatures which, after tempering, gives a fine hardening precipitation. It is advantageous to subject the alloy to cold-hammering during tempering to facilitate the precipitation and further improve the mechanical properties thereof.

Among useful copper alloys of this general class are copper-chromium alloys (0.5 to 0.9% Cr), copper-silver alloys (0.003 to 0.1% Ag), copper-beryllium alloys (1.8 to 2% Be), and copper-zirconium alloys, whose principal characteristics are summarized in Table 1, where $R_r$ represents the rupture charge and $R_e$ is the elastic limit, the other symbols having been defined hereinabove. The indicated values given in the Table are averages because they vary slightly with conditions in which the thermal treatment is effectuated.

Other useful alloys of the indicated class of alloys include those copper alloys with two additional components, such as chromium and zirconium, beryllium and cobalt, and beryllium and nickel, which fall under the above definition.

It will be seen that, while copper-chromium and copper-silver alloys have very good electric and thermal conductivities as well as fairly good mechanical characteristics, beryllium alloys of copper are less conductive but have better mechanical properties. All the alloys of this general class are useful for the mold.

Once the alloy for the mold wall has been selected, its thickness must be chosen so as to minimize the risk of deformation due to thermal strains. Since this increases proportionally with the thickness of the wall, the wall thickness must necessarily be kept to an acceptable minimum. We have calculated the thermal strains to which the internal mold wall is subjected at the level of the meniscus formed by the liquid metal during its rotation, i.e. at the location where the strain is highest. It is determined by the following formula:

$$\sigma_c = E\frac{\Phi}{\alpha}\,\frac{1}{1-\mu}\left[\frac{\log\left(\frac{d-2e}{d}\right)}{1-\left(\frac{d-2e}{d}\right)^2}+\frac{1}{2}\right]$$

wherein $d$ = outer diameter of the mold
$\Phi$ = heat flux at the level of the meniscus, and
$e$ = thickness of the mold wall
$E$ = Young's modulus
$\alpha$ = expansion coefficient,
$\lambda$ = thermal conductivity and
$\mu$ = Poisson's coefficient of the wall material.

Table 2 regroups the values of $\sigma_c$ calculated for copper-chromium, copper-silver and copper-beryllium 2% alloys, for different diameters and different wall thicknesses. The calculation was effected by taking a thermal flux value of 75 cal/cm²/second, which experimentation indicates to be a reasonable value. We have determined that permanent deformation of the mold is avoided if the thermal strain calculated on the basis of the above-indicated formula is about 60% of the elastic limit of the selected material. The maximum thickness of the mold wall may thus be calculated on the basis of the following formula:

$$\frac{\log\left(\frac{d-2e}{d}\right)}{1-\left(\frac{d-2e}{d}\right)^2} = \frac{0.6\times Re\times\lambda(1-\mu)}{E\,\alpha\,\phi}-\frac{1}{2}$$

wherein $e$ = the thickness of the wall;
$d$ = the diameter of the mold;
$\alpha$ = linear expansion coefficient,
$\lambda$ = thermal conductivity in cal/cm/sec.° C,
$E$ = Young modulus in kg/mm²,
$\mu$ = Poisson coefficient and
$Re$ = elastic limit in kg/mm² of the wall material; and
$\Phi$ = thermal flux at the level of the meniscus in cal/cm²/sec.

Taking the values given in Tables 1 and 2, it will be seen that the maximum thickness for copper-chromium walls is 12 mm, for copper-silver walls 11 mm and for copper-beryllium walls, which have a higher elastic limit, up to 15 mm. However, the wall must not be too thin since it must be able to withstand mechanical strains due to the pressure of the cooling water and the extraction of the cast product from the mold. The optimum thickness of the mold wall is about 8mm.

The depth of penetration of the magnetic field, even when alloys with the highest resistivity are selected from the indicated class, is still relatively weak if a frequency of rotation of the magnetic field is chosen which is equal to that of industrial current. Therefore, a lower frequency of rotation must be chosen but this value is limited by the fact that the speed of rotation of the liquid metal is less than that of the magnetic field and that it may not drop to such a low level that it fails to effectuate proper stirring. On the basis of these considerations, we have determined that a frequency of rotation between 4 and 15Hz, preferably 6 to 12 Hz, will attain optimum commercial results.

Turning magnetic fields for producing stirring of the liquid metal in the continuous casting of metal objects are usually obtained by polyphase inductors placed immediately behind the wall of the mold and immersed in the upper cooling chamber. There may be several pairs of poles per phase so as to obtain a low frequency of rotation with a supply current of 50 Hz. However, a single pair of poles per phase may be employed so as to obtain a uniform magnetic field which penetrates to the center of the air gap in the region where the liquid metal is on which it is desired to act. In this case, the angular velocity of rotation of the field, expressed in numbers of rotation, is equal to the frequency of the supply current.

The process of this invention may be used with advantage, for example, with the continuous casting mold described in the above-mentioned patent application and is applied preferably to the continuous casting of round billets. However, it may be readily adapted to the manufacture of products of square or substantially square cross section where the ratio of length to width is less than 1 : 3. It is particularly useful in the manufacture of products subjected to further treatments requiring superior surface characteristics and an absence of faults in the core of the structure.

Table 2-continued

| | Copper-silver | | | | | | |
|---|---|---|---|---|---|---|---|
| Diameter of the mold | 100 | 110 | 120 | 130 | 140 | 150 | 160 |
| 1 | 1.40 | 1.40 | 1.40 | 1.40 | 1.40 | 1.40 | 1.40 |
| 2 | 2.80 | 2.80 | 2.80 | 2.80 | 2.80 | 2.80 | 2.80 |
| 3 | 4.18 | 4.18 | 4.19 | 4.19 | 4.19 | 4.19 | 4.20 |
| 4 | 5.55 | 5.56 | 5.57 | 5.57 | 5.58 | 5.58 | 5.58 |
| 5 | 6.92 | 6.93 | 6.94 | 6.95 | 6.95 | 6.96 | 6.96 |
| 6 | 8.28 | 8.29 | 8.30 | 8.31 | 8.32 | 8.33 | 8.34 |
| 7 | 9.62 | 9.64 | 9.66 | 9.68 | 9.69 | 9.70 | 9.71 |
| Wall 8 | 10.96 | 10.99 | 11.01 | 11.03 | 11.05 | 11.06 | 11.07 |
| thick- 9 | 12.29 | 12.32 | 12.35 | 12.38 | 12.40 | 12.41 | 12.43 |
| ness 10 | 13.61 | 13.65 | 13.68 | 13.71 | 13.74 | 13.76 | 13.78 |
| in 11 | 14.92 | 14.97 | 15.01 | 15.05 | 15.08 | 15.10 | 15.13 |
| mm 12 | 16.22 | 16.28 | 16.33 | 16.37 | 16.41 | 16.44 | 16.47 |
| 13 | 17.51 | 17.58 | 17.64 | 17.69 | 17.73 | 17.77 | 17.80 |
| 14 | 18.80 | 18.88 | 18.94 | 19.00 | 19.05 | 19.10 | 19.13 |
| 15 | 20.07 | 20.16 | 20.24 | 20.30 | 20.36 | 20.41 | 20.46 |
| 16 | 21.34 | 21.44 | 21.53 | 21.60 | 21.67 | 21.72 | 21.77 |
| 17 | 22.59 | 22.71 | 22.81 | 22.89 | 22.97 | 23.03 | 23.08 |
| 18 | 23.84 | 23.97 | 24.09 | 24.18 | 24.26 | 24.33 | 24.39 |
| 19 | 25.08 | 25.23 | 25.35 | 25.45 | 25.54 | 25.62 | 25.70 |

| | Copper-2%berylium | | | | | |
|---|---|---|---|---|---|---|
| Diameter of the mold | 50 | 60 | 70 | 80 | 90 | 100 |
| 1 | 1.54 | 1.54 | 1.54 | 1.54 | 1.54 | 1.54 |
| 2 | 3.06 | 3.06 | 3.07 | 3.07 | 3.07 | 3.08 |
| 3 | 4.57 | 4.58 | 4.59 | 4.59 | 4.60 | 4.60 |
| 4 | 6.08 | 6.09 | 6.10 | 6.11 | 6.12 | 6.12 |
| 5 | 7.57 | 7.59 | 7.61 | 7.62 | 7.63 | 7.64 |
| 6 | 9.06 | 9.09 | 9.11 | 9.13 | 9.14 | 9.15 |
| 7 | 10.53 | 10.57 | 10.60 | 10.62 | 10.64 | 10.66 |
| Wall 8 | 12.00 | 12.05 | 12.09 | 12.12 | 12.14 | 12.16 |
| thick- 9 | 13.45 | 13.52 | 13.57 | 13.60 | 13.63 | 13.65 |
| ness 10 | 14.89 | 14.98 | 15.04 | 15.08 | 15.12 | 15.15 |
| in 11 | 16.33 | 16.43 | 16.50 | 16.56 | 16.60 | 16.63 |
| mm 12 | 17.75 | 17.87 | 17.96 | 18.02 | 18.07 | 18.11 |
| 13 | 19.17 | 19.31 | 19.41 | 19.48 | 19.54 | 19.59 |
| 14 | 20.57 | 20.73 | 20.85 | 20.94 | 21.01 | 21.06 |
| 15 | 21.95 | 22.15 | 22.29 | 22.39 | 22.47 | 22.53 |
| 16 | 23.35 | 23.56 | 23.71 | 23.83 | 23.92 | 23.99 |
| 17 | 24.73 | 24.96 | 25.14 | 25.26 | 25.37 | 25.45 |
| 18 | 26.09 | 26.36 | 26.55 | 26.69 | 26.81 | 26.90 |
| 19 | 27.45 | 27.74 | 27.96 | 28.12 | 28.24 | 28.34 |

We claim:

1. In a process of continuously casting a metallic product by electromagnetic centrifuging, wherein a liquid metal is injected into a cooled ingot mold having an axis, the metal is rotated by applying thereto a magnetic field turning about the axis of the mold, the magnetic field being produced by a polyphase inductor placed in the immediate proximity of the cast product,

TABLE 1

| | Copper-chromium | Copper-silver | Copper-2% Be | Copper-5% Be | Copper-zirconium |
|---|---|---|---|---|---|
| λ cal/cm./sec.° C | 0.85 | 0.9 | 0.25 | 0.5 | 0.8 |
| ρμΩ/cm. | 2.15 to 3.83 | 1.8 | 9.8 | 3.7 to 7.6 | 1.8 to 2.4 |
| $R_e$ kg/mm² | 28 | 25 | 126 | 60 | 12 |
| $R_r$ kg/mm² | 40 | 30 | 140 | 70 | 28 |

Table 2

| | Copper-chromium | | | | | | |
|---|---|---|---|---|---|---|---|
| Diameter of the mold | 100 | 110 | 120 | 130 | 140 | 150 | 160 |
| 1 | 1.51 | 1.51 | 1.51 | 1.51 | 1.51 | 1.51 | 1.51 |
| 2 | 3.01 | 3.01 | 3.01 | 3.01 | 3.02 | 3.02 | 3.02 |
| 3 | 4.50 | 4.50 | 4.51 | 4.51 | 4.51 | 4.52 | 4.52 |
| 4 | 5.98 | 5.99 | 6.00 | 6.00 | 6.00 | 6.01 | 6.01 |
| 5 | 7.45 | 7.46 | 7.47 | 7.48 | 7.49 | 7.49 | 7.50 |
| 6 | 8.91 | 8.93 | 8.94 | 8.95 | 8.96 | 8.97 | 8.98 |
| 7 | 10.36 | 10.38 | 10.40 | 10.42 | 10.43 | 10.44 | 10.45 |
| Wall 8 | 11.80 | 11.83 | 11.86 | 11.88 | 11.89 | 11.91 | 11.92 |
| thick- 9 | 13.23 | 13.27 | 13.30 | 13.33 | 13.35 | 13.37 | 13.33 |
| ness 10 | 14.65 | 14.70 | 14.74 | 14.77 | 14.79 | 14.82 | 14.84 |
| in 11 | 16.06 | 16.12 | 16.16 | 16.20 | 16.24 | 16.26 | 16.29 |
| mm 12 | 17.46 | 17.53 | 17.58 | 17.63 | 17.67 | 17.70 | 17.73 |
| 13 | 18.86 | 18.93 | 18.99 | 19.05 | 19.10 | 19.13 | 19.17 |
| 14 | 20.24 | 20.33 | 20.40 | 20.46 | 20.51 | 20.56 | 20.60 |
| 15 | 21.61 | 21.71 | 21.79 | 21.86 | 21.93 | 21.98 | 22.03 |
| 16 | 22.97 | 23.09 | 23.18 | 23.26 | 23.33 | 23.39 | 23.44 |
| 17 | 24.33 | 24.46 | 24.56 | 24.65 | 24.73 | 24.80 | 24.86 |
| 18 | 25.67 | 25.81 | 25.93 | 26.03 | 26.12 | 26.20 | 26.26 |
| 19 | 27.01 | 27.16 | 27.30 | 27.41 | 27.51 | 27.59 | 27.66 |

and the metal is extracted from the mold in partially solidified condition, the step of obtaining a maximal stirring intensity of the liquid metal in the mold by a. rotating the magnetic field at a frequency of rotation of 4 to 15 Hertz, b. using a copper alloy of structural rigidity for the mold wall, and c. keeping the thickness of the mold wall below a value calculated by the formula $$\frac{\log\left(\frac{d-2e}{d}\right)}{1-\left(\frac{d-2e}{d}\right)^2} = \frac{0.6 \times Re \times \lambda(1-\mu)}{E\,\alpha\,\phi} - \frac{1}{2}$$

wherein $e$ = the thickness of the wall;
$d$ = the diameter of the mold;
$\alpha$ = linear expansion coefficient,
$\lambda$ = thermal conductivity in cal/cm/sec. ° C,
$E$ = Young's modulus in kg/mm$^2$,
$\mu$ = Poisson's coefficient and
$Re$ = elastic limit in kg/mm$^2$ of the wall material; and
$\Phi$ = thermal flux at the level of the meniscus in cal/cm$^2$/sec.

2. In the process of claim 1, the step of rotating the magnetic field at a frequency of rotation of 6 to 12 Hertz.

3. In the process of claim 1, the step of keeping the thickness of the mold wall below 15 mm.

4. In the process of claim 3, the step of keeping the thickness of the mold wall equal to about 8 mm.

5. In the process of claim 1, wherein the magnetic field is produced by a polyphase electromagnetic inductor with a pair of poles per phase.

6. In the process of claim 1, wherein the turning magnetic field has an effective intensity of at least 800 Gauss.

7. In the process of claim 6, wherein the turning magnetic field has an effective intensity of 1000 to 2000 G.

* * * * *